US007121351B2

(12) United States Patent
Luke et al.

(10) Patent No.: US 7,121,351 B2
(45) Date of Patent: Oct. 17, 2006

(54) APPARATUS AND METHOD FOR COMPLETING A WELLBORE

(75) Inventors: Mike A. Luke, Houston, TX (US); Wayne Rudd, Newcastle upon Tyne (GB); Simon J. Harrall, Inverurie (GB); David M. Haugen, League City, TX (US); Paul David Metcalfe, Banchory (GB); Frederick T. Tilton, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 141 days.

(21) Appl. No.: 10/808,249

(22) Filed: Mar. 24, 2004

(65) Prior Publication Data

US 2005/0045342 A1 Mar. 3, 2005

Related U.S. Application Data

(63) Continuation-in-part of application No. 10/725,340, filed on Dec. 1, 2003, and a continuation-in-part of application No. 10/032,998, filed on Oct. 25, 2001, now Pat. No. 6,708,767.

(60) Provisional application No. 60/467,503, filed on May 2, 2003.

(30) Foreign Application Priority Data

Oct. 25, 2000 (GB) ..... 0026063.8

(51) Int. Cl.
*E21B 23/02* (2006.01)

(52) U.S. Cl. ..... 166/382; 166/207; 166/217

(58) Field of Classification Search ..... 166/382, 166/207, 217, 384, 385, 277, 206, 216

See application file for complete search history.

(56) References Cited

U.S. PATENT DOCUMENTS

| | | | |
|---|---|---|---|
| 761,518 | A | 5/1904 | Lykken |
| 1,324,303 | A | 12/1919 | Carmichael |
| 1,545,039 | A | 7/1925 | Deavers |
| 1,561,418 | A | 11/1925 | Duda |
| 1,569,729 | A | 1/1926 | Duda |
| 1,597,212 | A | 8/1926 | Spengler |
| 1,930,825 | A | 10/1933 | Raymond |
| 2,383,214 | A | 8/1945 | Prout |
| 2,499,630 | A | 3/1950 | Clark |

(Continued)

FOREIGN PATENT DOCUMENTS

| | | |
|---|---|---|
| EP | 0 353 309 | 11/1988 |

(Continued)

OTHER PUBLICATIONS

U.K. Search Report, Application No. GB0506187.4, dated May 5, 2005.

(Continued)

*Primary Examiner*—Frank S. Tsay
(74) *Attorney, Agent, or Firm*—Patterson & Sheridan, LLP

(57) ABSTRACT

The present invention generally relates to an apparatus and method for expanding a tubular body in a wellbore. In one aspect, a method includes running the tubular body into the wellbore, the tubular body having a deformed portion. The method further includes reforming the deformed portion and positioning a two-position expander in the reformed portion. Additionally, the method includes shifting the expander to a second, larger diameter position and then expanding the reformed portion by urging the expander therethrough. In another aspect, a method for completing a wellbore is provided. In yet another aspect, a formable launcher section is provided. In a further aspect, a two-position expander tool is provided. In yet another aspect, an expansion system for use in completing a wellbore is provided.

31 Claims, 11 Drawing Sheets

U.S. PATENT DOCUMENTS

| | | | | | |
|---|---|---|---|---|---|
| 2,627,891 | A | | 2/1953 | Clark | |
| 2,683,073 | A | | 12/1953 | Bieber, et al. | |
| 2,898,971 | A | | 8/1959 | Hempel | |
| 3,087,546 | A | | 4/1963 | Woolley | |
| 3,195,646 | A | | 7/1965 | Brown | |
| 3,203,483 | A | | 8/1965 | Vincent | |
| 3,467,180 | A | | 9/1969 | Pensotti | |
| 3,545,543 | A | | 12/1970 | Kammerer, Jr. et al. | |
| 3,776,307 | A | | 12/1973 | Young | |
| 3,818,734 | A | | 6/1974 | Bateman | |
| 3,911,707 | A | | 10/1975 | Minakov, et al. | |
| 4,069,573 | A | | 1/1978 | Rogers, Jr. et al. | |
| 4,127,168 | A | | 11/1978 | Hanson et al. | |
| 4,159,564 | A | | 7/1979 | Cooper, Jr. | |
| 4,288,082 | A | | 9/1981 | Setterberg, Jr. | |
| 4,324,407 | A | | 4/1982 | Upham et al. | |
| 4,429,620 | A | | 2/1984 | Burkhardt et al. | |
| 4,531,581 | A | | 7/1985 | Pringle et al. | |
| 4,588,030 | A | | 5/1986 | Blizzard | |
| 4,697,640 | A | | 10/1987 | Szarka | |
| 4,848,469 | A | | 7/1989 | Baugh et al. | |
| 4,976,322 | A | | 12/1990 | Abdrakhmanov et al. | |
| 5,014,779 | A | | 5/1991 | Meling et al. | |
| 5,031,699 | A | | 7/1991 | Artynov et al. | |
| 5,083,608 | A | | 1/1992 | Abdrakhmanov et al. | |
| 5,271,472 | A | | 12/1993 | Leturno | |
| 5,409,059 | A | | 4/1995 | McHardy | |
| 5,435,400 | A | | 7/1995 | Smith | |
| 5,472,057 | A | | 12/1995 | Winfree | |
| 5,560,426 | A | | 10/1996 | Trahan et al. | |
| 5,685,369 | A | | 11/1997 | Ellis et al. | |
| 5,785,120 | A | | 7/1998 | Smalley et al. | |
| 5,794,702 | A | * | 8/1998 | Nobileau | 166/380 |
| 5,901,787 | A | | 5/1999 | Boyle | |
| 5,957,195 | A | | 9/1999 | Bailey et al. | |
| 5,979,560 | A | * | 11/1999 | Nobileau | 166/381 |
| 6,021,850 | A | | 2/2000 | Wood et al. | |
| 6,098,717 | A | | 8/2000 | Bailey et al. | |
| 6,138,751 | A | | 10/2000 | Freeman et al. | |
| 6,138,761 | A | * | 10/2000 | Freeman et al. | 166/313 |
| 6,142,230 | A | | 11/2000 | Smalley et al. | |
| 6,325,148 | B1 | | 12/2001 | Trahan et al. | |
| 6,425,444 | B1 | | 7/2002 | Metcalfe et al. | |
| 6,446,323 | B1 | | 9/2002 | Metcalfe et al. | |
| 6,454,013 | B1 | | 9/2002 | Metcalfe | |
| 6,457,532 | B1 | | 10/2002 | Simpson | |
| 6,457,533 | B1 | | 10/2002 | Metcalfe | |
| 6,527,049 | B1 | | 3/2003 | Metcalfe et al. | |
| 6,543,552 | B1 | | 4/2003 | Metcalfe et al. | |
| 6,543,816 | B1 | | 4/2003 | Noel | |
| 6,629,568 | B1 | | 10/2003 | Post et al. | |
| 6,688,397 | B1 | | 2/2004 | McClurkin et al. | |
| 6,702,029 | B1 | | 3/2004 | Metcalfe et al. | |
| 6,708,767 | B1 | | 3/2004 | Harrall et al. | |
| 6,712,401 | B1 | | 3/2004 | Coulon et al. | |
| 6,860,329 | B1 | | 3/2005 | Oosterling | |
| 2002/0108756 | A1 | | 8/2002 | Harrall et al. | |
| 2002/0166664 | A1 | | 11/2002 | Lauritzen et al. | |
| 2003/0150608 | A1 | | 8/2003 | Smith, Jr. et al. | |
| 2003/0168222 | A1 | | 9/2003 | Maguire et al. | |
| 2003/0230410 | A1 | | 12/2003 | Underhill | |
| 2004/0020659 | A1 | | 2/2004 | Hall et al. | |
| 2004/0020660 | A1 | | 2/2004 | Johnson et al. | |
| 2004/0159446 | A1 | | 8/2004 | Haugen et al. | |
| 2004/0177953 | A1 | | 9/2004 | Wubben | |
| 2004/0262014 | A1 | | 12/2004 | Cook et al. | |
| 2005/0045342 | A1 | | 3/2005 | Luke et al. | |
| 2005/0161213 | A1 | | 7/2005 | Sonnier et al. | |
| 2005/0269107 | A1 | | 12/2005 | Cook et al. | |

FOREIGN PATENT DOCUMENTS

| | | |
|---|---|---|
| EP | 0 397 874 | 11/1988 |
| EP | 0 397870 | 11/1988 |
| EP | 0 961 007 | 12/1999 |
| GB | 1 485 099 | 9/1977 |
| GB | 2 086 282 | 5/1982 |
| GB | 2 320 734 | 7/1998 |
| GB | 2 374 101 | 10/2002 |
| GB | 2 383 361 | 6/2003 |
| GB | 2 388 130 | 11/2003 |
| GB | 2 388 137 | 11/2003 |
| GB | 2 401 131 | 11/2004 |
| RU | 2 083 798 | 7/1997 |
| RU | 2 187 619 | 8/2002 |
| RU | 2187619 | 8/2002 |
| SU | 1745873 | 7/1992 |
| SU | 1745873 A1 | 7/1992 |
| WO | WO 84/00120 | 1/1984 |
| WO | WO 93/24728 | 12/1993 |
| WO | WO 99/18328 | 12/1993 |
| WO | WO 99/23354 | 5/1999 |
| WO | WO 00/31375 | 6/2000 |
| WO | WO 00/37766 | 6/2000 |
| WO | WO 00/37771 | 6/2000 |
| WO | WO 01/18354 | 3/2001 |
| WO | WO 01/38693 | 5/2001 |
| WO | WO 01/98623 | 12/2001 |
| WO | WO 02/29199 | 4/2002 |
| WO | WO 02/053867 | 7/2002 |
| WO | WO 02/059456 | 8/2002 |
| WO | WO 02/066783 | 8/2002 |
| WO | WO 03/006788 | 1/2003 |
| WO | WO 03/029607 | 4/2003 |
| WO | WO 03/036018 | 5/2003 |
| WO | WO 03/042487 | 5/2003 |
| WO | WO 03/071086 | 8/2003 |
| WO | WO 03/083258 | 10/2003 |
| WO | WO 03/102365 | 12/2003 |
| WO | WO 05/003511 | 1/2005 |
| WO | WO 2005/003511 | 1/2005 |

OTHER PUBLICATIONS

Gabdrashit S. Abdrakhmanov, Rustam Ibatullin, Bradley M. Robinson, and W. E. (Bill) Powell, Isolation Profile Liner Helps Stabilize Problem Well Bores, Technology.

Shafagat F. Takhautdinov, Gaborashit S. Abdrakhmanov. Nigmatyan K. Khamityanov, Nail N. Vildanov, and Khamit Z. Kaveev, Expandable Profile Liners in Well Construction, Oil and Gas Journal, Aug. 12, 2002.

Adam T. Bourgoyne, Jr., Keith K. Millheim, Martin E. Chenevert, and F.S. Young, Jr., Applied Drilling Engineering, p. 428, Society of Petroleum Engineers, 1986.

* cited by examiner

APPARATUS AND METHOD FOR COMPLETING A WELLBORE

CROSS-REFERENCE TO RELATED APPLICATIONS

This application is a continuation-in part of co-pending U.S. patent application Ser. No. 10/725,340, filed on Dec. 1, 2003, which claims benefit of U.S. Provisional Application No. 60/467,503, filed on May 2, 2003, and which is a continuation-in part of U.S. patent application Ser. No. 10/032,998, filed on Oct. 25, 2001 now U.S. Pat. No. 6,708,767, which claims benefit of Great Britain Application Serial Number 0026063.8, filed on Oct. 25, 2000, which are herein incorporated by reference in their entirety.

BACKGROUND OF THE INVENTION

1. Field of the Invention

The present invention generally relates to an apparatus and method for completing a wellbore. More particularly, the invention relates to an apparatus and method for expanding a tubular body in a wellbore.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using an apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing or conductor pipe is then run into the wellbore and set in the drilled out portion of the wellbore, and cement is circulated into the annulus behind the casing string. Next, the well is drilled to a second designated depth, and a second string of casing, or liner, is run into the drilled out portion of the wellbore. The second string is set at a depth such that the upper portion of the second string of casing overlaps the lower portion of the first string of casing. The second liner string is then fixed, or "hung" off of the existing casing by the use of slips which utilize slip members and cones to wedgingly fix the new string of liner in the wellbore. The second casing string is then cemented. This process is typically repeated with additional casing strings until the well has been drilled to total depth. As more casing strings are set in the wellbore, the casing strings become progressively smaller in diameter in order to fit within the previous casing string. In this manner, wells are typically formed with two or more strings of casing of an ever-decreasing diameter.

Decreasing the diameter of the wellbore produces undesirable consequences. Progressively decreasing the diameter of the casing strings with increasing depth within the wellbore limits the size of wellbore tools which are capable of being run into the wellbore. Furthermore, restricting the inner diameter of the casing strings limits the volume of hydrocarbon production fluids which may flow to the surface from the formation.

In the last several years, methods and apparatus for expanding the diameter of casing strings within a wellbore have become feasible. For example, a string of liner can be hung in a well by placing the upper portion of a second string of casing in an overlapping arrangement with the lower portion of a first string of casing. The second string of casing is then expanded into contact with the existing first string of casing with an expander tool. The second string of casing is then cemented.

An exemplary expander tool utilized to expand the second casing string into the first casing string is fluid powered and run into the wellbore on a working string. The hydraulic expander tool includes radially expandable members which, through fluid pressure, are urged outward radially from the body of the expander tool and into contact with the second casing string therearound. As sufficient pressure is generated on a piston surface behind these expansion members, the second casing string being acted upon by the expansion tool is expanded past its point of elastic deformation. In this manner, the inner and outer diameter of the expandable tubular is increased in the wellbore. By rotating the expander tool in the wellbore and/or moving the expander tool axially in the wellbore with the expansion member actuated, a tubular can be expanded into plastic deformation along a predetermined length in a wellbore.

Recently, an expansion system has been developed to line a borehole with an entire section of expandable tubing. Generally, the expansion system 65 includes a liner assembly 75 and an expansion assembly 85 as will discussed in prior art FIGS. 1A–1F. Prior to running the expansion system 65 into the wellbore, a borehole 50 is formed below an existing string of casing 60 by a standard drill bit (not shown). To prepare the borehole 50 for placement of the expansion system 65, an under-reaming procedure is employed using a standard under-reamer 55 to enlarge the inside diameter of the borehole 50 as illustrated in FIG. 1A. Thereafter, the expansion system 65 is run into the under-reamed borehole 50 as shown in FIG. 1B. The liner assembly 75 includes a string of expandable liner 70 with a preformed launcher section 30 formed at the lower end thereof. The expansion assembly 85 includes an expander cone 35 that is placed in the preformed launcher section 30 prior to running the expansion system 65 into the under-reamed borehole 50. After the placement of the expansion system 65, cement is pumped through the expansion system 65 to fill an annulus 40 formed between the expansion system 65 and the surrounding borehole 50 as shown in FIG. 1C. Prior to the curing of the cement, fluid is pumped through the expansion system 65 to urge the expander cone 35 through the expandable liner 70 as depicted in FIG. 1D. Subsequently, the expander cone 35 expands an upper portion of the liner 70 into contact with the inside diameter of the casing 60 to form a sealing relationship therebetween as shown in FIG. 1E. Next, the expansion assembly 85 is then removed from the borehole 50 and a mill 45 is employed to mill out a shoe 80 at the lower end of the liner assembly 75 as illustrated in FIG. 1F.

There are certain disadvantages of using the prior art expansion system illustrated in FIGS. 1A–1F. One disadvantage relates to preparation of the borehole below the existing casing string prior to the placement of the expansion system in the wellbore. More specifically, an under-reaming operation must be conducted after the borehole has been formed in order to enlarge the inner diameter of the borehole so that the expansion system with the preformed launcher portion may be positioned in the borehole. Another disadvantage relates to the fact that a tubular can only be expanded about 22–25% past its elastic limit using the method described above. Expansion past about 22–25% of its original diameter may cause the liner to fracture due to stress. Securing the liner in the borehole by expansion alone would require an increase in diameter of over 25%. Therefore, the cementation operation must be employed to fill in the annulus formed between the expanded liner and the borehole.

There is, therefore, a need for a method and an apparatus for placing a liner in a borehole without preparing the borehole with an under-reaming operation. There is a further need for a method and apparatus for expanding the diameter of a tubular string past the current limit of 25%. There is yet a further need for a method and an apparatus for expanding a lower portion of a casing string or tubular body to a diameter larger than the diameter of the tubular thereabove without compromising the structural integrity.

SUMMARY OF THE INVENTION

The present invention generally relates to an apparatus and method for expanding a tubular body in a wellbore. In one aspect, a method includes running the tubular body into the wellbore, the tubular body having a deformed portion. The method further includes reforming the deformed portion and positioning a two-position expander in the reformed portion. Additionally, the method includes shifting the expander to a second, larger diameter position and then expanding the reformed portion by urging the expander therethrough.

In another aspect, a method for completing a wellbore is provided. The method includes forming a borehole below an existing string of casing and running a tubular body having a deformed portion into the borehole. The method further includes reforming the deformed portion and positioning a two-position expander in the reformed portion. Additionally, the method includes shifting the expander to a second, larger diameter position and expanding at least the portion of the tubular body into contact with the borehole.

In yet another aspect, a formable launcher section is provided. The launcher section includes a deformed tubular defining a first largest folded diameter, wherein the deformed tubular may be reformed to define a second largest folded diameter and subsequently expanded to define a third largest unfolded diameter which is substantially tubular-shaped. The launcher section further includes a shoe operatively attached to a lower end of the deformed tubular.

In a further aspect, a two-position expander tool is provided. The two-position expander includes a plurality of first cone segments with a track formed on an edge thereof. The two-position expander further includes a plurality of second cone segments with a mating track formed on an edge thereof. The cone segments are constructed and arranged to move radially outward as they move along the tracks toward each other, thereby causing the tool to assume the second, larger diameter position.

In yet another aspect, an expansion system for use in completing a wellbore is provided. The expansion system includes a deformed liner portion and a two-position expander, wherein the two-position expander is disposable in the deformed liner portion upon reforming thereof.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention is generally directed to a method and apparatus for lining a wellbore using an expansion system. The expansion system includes a liner assembly and an expansion assembly as will be described in the following paragraphs. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same number indicator. The drawings may be, but are not necessarily, to scale, and the proportions of certain parts have been exaggerated to better illustrate details and features of the invention. One of ordinary skill in the art of expansion systems will appreciate that the embodiments of the invention can and may be used in various types of structures, such as conduits, pipelines, piles, vertical wellbores, horizontal wellbores, or deviated wellbores. For clarity, the invention will be described as it relates to a vertical wellbore.

Figures 1A, 1B, 1C, 1D, 1E, 1F:
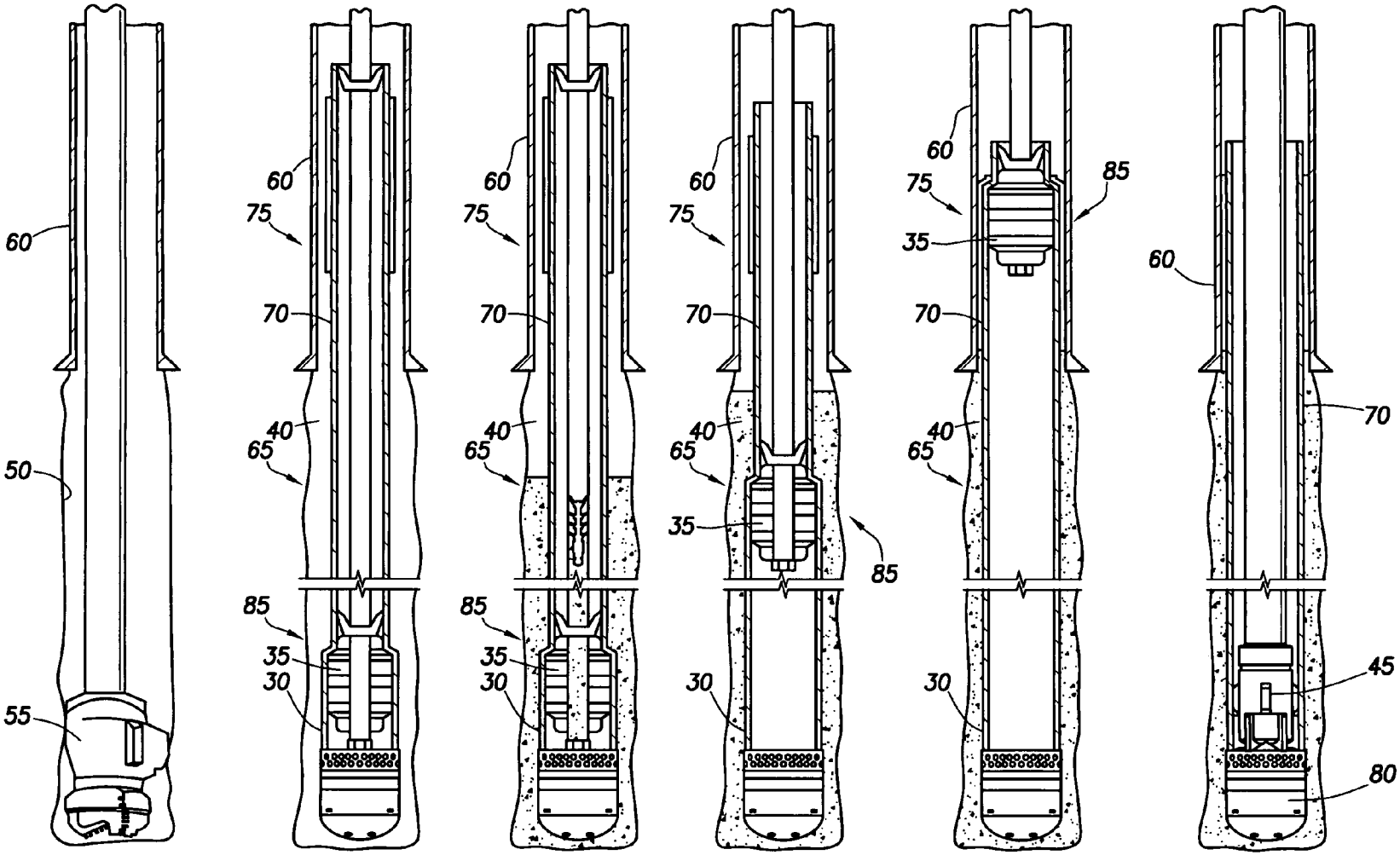
FIG. 1A (PRIOR ART)
FIG. 1B (PRIOR ART)
FIG. 1C (PRIOR ART)
FIG. 1D (PRIOR ART)
FIG. 1E (PRIOR ART)
FIG. 1F (PRIOR ART)
FIG. 1A is a sectional view illustrating the preparation of a borehole for the placement of a prior art expansion system.
FIG. 1B is a sectional view illustrating the prior art expansion system positioned below an existing string of casing.
FIG. 1C is a sectional view illustrating a cementing operation prior to the expansion of a liner.
FIG. 1D is a sectional view illustrating a liner being expanded by an expander cone.
FIG. 1E is a sectional view illustrating the liner being expanded into contact with the existing string of casing.
FIG. 1F is a sectional view illustrating a shoe being removed by a milling operation.
Figure 2A:
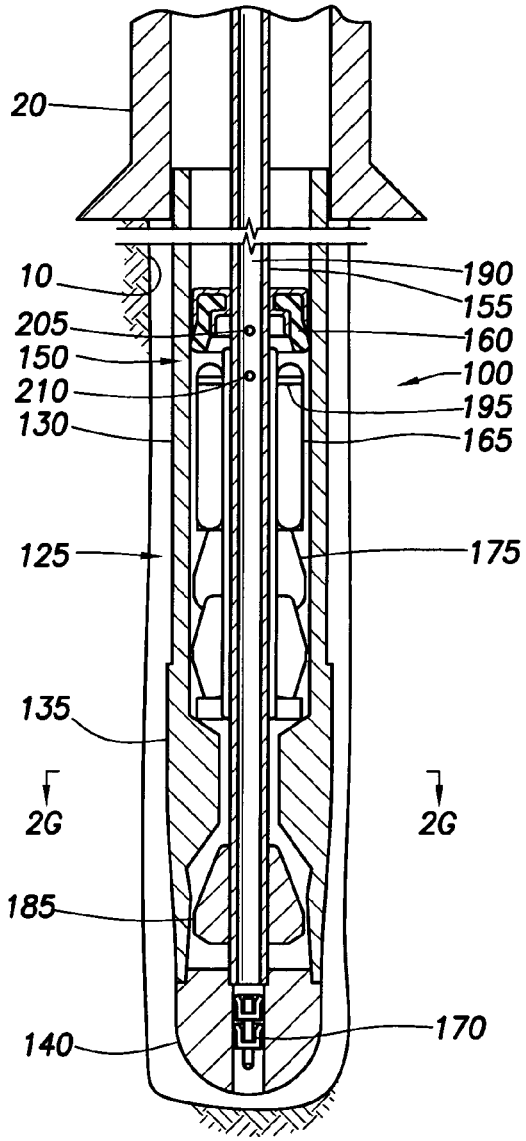
FIG. 2A is a sectional view of an expansion system of the present invention disposed in a wellbore proximate a lower end of a string of casing.

FIG. 2A is a sectional view of an expansion system 100 disposed in a wellbore 10 proximate a lower end of a string of casing 20. The system 100 includes a liner assembly 125 and an expansion assembly 150. The liner assembly 125 is set in the casing 20 by positioning an upper portion of the liner assembly 125 in an overlapping relationship with a lower portion of the casing 20, as illustrated in FIG. 2A. Thereafter, the expansion assembly 150 is employed to expand the liner assembly 125 into engagement with the casing 20 and the surrounding wellbore 10 as will be further described herein.

As shown in FIG. 2A, the expansion system 100 has an outer diameter smaller than the inside diameter of the casing string 20, thereby allowing the expansion system 100 to move freely through the casing string 20 without substantial interference. Furthermore, the outer diameter of the expansion system 100 permits the placement of the expansion system 100 in the wellbore 10 formed by a standard drill bit (not shown). The wellbore 10 does not require an under-reaming procedure prior to the placement of the expansion system 100 in the wellbore 10.

The liner assembly 125 includes a substantially cylindrical liner section 130 at an upper end thereof. The liner section 130 is preferably made from a solid expandable tubular. However, other types of expandable tubulars as known in the art, such as slotted liner, may be employed without departing from principles of the present invention. As illustrated, an upper portion of the liner section 130 is in an overlapping relationship with the casing 20. Thus, upon expansion thereof, a portion of the liner section 130 contacts the inner diameter of the casing 20 to create a seal therebetween. In one embodiment, a plurality of seal members (not shown) may be employed between the outer diameter of the liner section 130 and the casing 20 to further enhance the sealing relationship therebetween.

The liner assembly 125 further includes a shaped or a corrugated liner section 135 disposed at the lower end of the substantially cylindrical liner section 130. It should be understood, however, that the corrugated liner section 135 may be located at any position along the liner assembly 125 without departing from principles of the present invention. The corrugated liner section 135 and the substantially cylindrical liner section 130 may be connected (preferably threadedly connected) to one another or may be one continuous tubular body. Preferably, the corrugated liner section 135 is fabricated from a drillable material, such as aluminum or a pliable composite. Initially, the corrugated liner section 135 has a folded wall describing a folded diameter which can be reformed to define a larger folded diameter and subsequently can be expanded to define a still larger unfolded diameter. The corrugated liner section 135 is folded or deformed, preferably prior to insertion into the wellbore 10, to a shape other than tubular-shaped so that it is corrugated or crinkled to form grooves 145, as shown in FIG. 2G. A tubular-shaped body is generally cylindrical. As depicted in FIG. 2G, the grooves 145 are formed along the length of the corrugated liner section 135. The shape of the corrugated liner section 135 and the extent of corrugation of the corrugated liner section 135 is not limited to the shape depicted in FIG. 2G. The grooves 145 may be symmetric or asymmetric. The only limitation on the shape of the corrugated liner section 135 and the extent of the corrugations of the corrugated liner section 135 is that the corrugated liner section 135 must not be deformed in such a fashion that reformation of the corrugated liner section 135, as will be discussed herein, causes sufficient stress on any particular portion of the corrugated liner section 135 to permit the corrugated liner section 135 to fracture in that portion upon reformation.

As illustrated in FIG. 2A, the liner assembly 125 further includes a shoe 140 at the lower end thereof. Generally, the shoe 140 is a tapered, often bullet-nosed piece of equipment that guides the liner assembly 125 toward the center of the wellbore 10 and minimizes problems associated with hitting rock ledges or washouts in the wellbore 10 as the liner assembly 125 is lowered into the well. The outer portions of the shoe 140 are preferably made from steel, generally matching the casing in size and threads, if not steel grade. The inside of the shoe 140 (including the taper) is preferably made of a drillable material such as cement, aluminum or thermoplastic, since this material must be drilled out if the well is to be deepened beyond the casing point. Furthermore, a hole is formed in the shoe 140 to provide a fluid pathway through the shoe 140. The hole includes a seat for a hydraulic isolation device 170 as will be discussed in a subsequent paragraph. The shoe 140 also provides a means for supporting the liner assembly 125 as the expansion system 100 is run into the wellbore 10.

As shown, the expansion assembly 150 is disposed in the liner assembly 125. The expansion assembly 150 includes a tubular member 155 that runs the entire length of the expansion assembly 150. An upper end of the tubular member 155 is attached to a work string (not shown) and a lower end of the tubular member 155 is releaseably connected to the shoe 140 of the liner assembly 125. The tubular member 155 includes a bore 190 in fluid communication with the surface of the wellbore 10. Among other things, the tubular member 155 provides a means for supporting the liner assembly 125.

The expansion assembly 150 further includes a front seal 160 at the upper end thereof. The front seal 160 is operatively attached to the tubular member 155. The front seal 160 is preferably fabricated from a pliable material, such as an elastomer, to provide a fluid tight seal between the expansion assembly 150 and the liner assembly 125. The primary function of the front seal 160 is to act as a fluid piston to move the expansion assembly 150 through the liner assembly 125 upon introduction of a fluid pressure below the front seal 160. It should be understood, however, that the expansion assembly 150 may also be urged through the liner assembly 125 by mechanical force without departing from principles of the present invention.

Further, the expansion assembly 150 includes a hydraulic cylinder 165 below the front seal 160. The hydraulic cylinder 165 is operatively attached to the outer surface of the tubular member 155 and is in fluid communication with the bore 190 through a selectively actuated port 210, which is initially closed. The hydraulic cylinder 165 includes a piston 195 disposed therein. The piston 195 is movable along the tubular member 155 as fluid enters through the selectively actuated port 210. The primary purpose of the hydraulic cylinder 165 is to move a two-position expander 175 from a first position as shown in FIG. 2A to a second position as shown in FIG. 2D. To that end, the piston 195 is operatively attached to two-position expander 175.

Referring back to FIG. 2A, the expansion assembly 150 also includes a lower cone 185 disposed at the lower end thereof. The lower cone 185 is a tapered member that is attached to the tubular member 155, whereby movement of the tubular member 155 in relation to the liner assembly 125 will also move the cone 185. As shown, during the run-in procedure, the two-position expander 175 is disposed adjacent to one end of the corrugated liner section 135 and the lower cone 185 is disposed adjacent to the other end of the corrugated liner section 135.

The expansion system 100 is lowered into the wellbore 10 while simultaneously circulating fluid through the expansion system 100. After the expansion system 100 is positioned within the wellbore 10, the hydraulic isolation device 170 is introduced into the bore 190 of the tubular member 155. Thereafter, the hydraulic isolation device 170 travels through the bore 190 until it lands in the seat of the shoe 140 thus closing off fluid communication through the shoe 140. As additional fluid is introduced into the bore 190 from the surface of the wellbore 10, the fluid exits a secondary actuated port 205 below the front seal 160. As fluid pressure builds on the lower surface of the front seal 160, the expansion assembly 150 begins to move upward relative to the liner assembly 125. The upward movement of the expansion assembly 150 introduces the lower cone 185 into contact with the corrugated liner section 135 to start reforming or unfolding the corrugated liner section 135 from the folded diameter to the larger folded diameter.

Figure 2B:
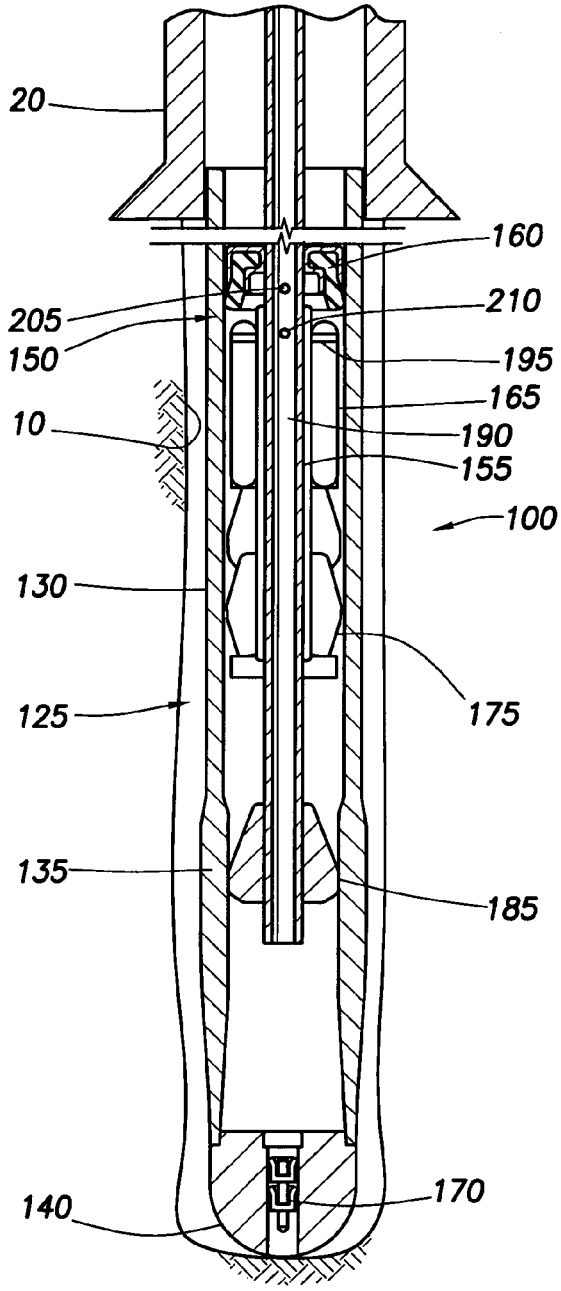
FIG. 2B is a sectional view illustrating a corrugated liner being unfolded by a lower cone to form a launcher.
Figure 2G:
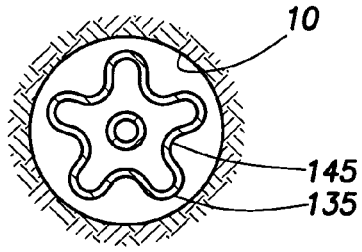
FIG. 2G is a cross-sectional view illustrating a corrugated liner.

FIG. 2B is a sectional view illustrating the lower cone 185 reforming or unfolding the corrugated liner section 135 to form a launcher. The launcher is an area in the liner assembly 125 that is formed to house the unactuated two-position expander 175 prior to expanding the liner into the wellbore 10. Due to fluid pressure below the front seal 160, the expansion assembly 150 moves upward relative to the liner assembly 125 and therefore urges the cone 185 through the corrugated liner section 135. The cone 185 partially reforms or unfolds the corrugated liner section 135 from the initial folded diameter to the larger folded diameter which is substantially the same diameter as the largest diameter of the cone 185. It should be noted, however, that the corrugated liner section 135 still remains substantially corrugated upon the formation of the launcher. Additionally, as the expansion assembly 150 moves upward, the lower end of the tubular member 155 is disconnected from the shoe 140.

After the corrugated liner section 135 is partially reformed by the cone 185, the fluid pressure below the seal 160 is released by allowing fluid to exit through the tubular member 155, thereby causing the expansion assembly 150 to move relative to the liner assembly 125 toward the shoe 140. Upon contact with the shoe 140, the tubular member 155 is reattached to the shoe 140.

Figure 2C:
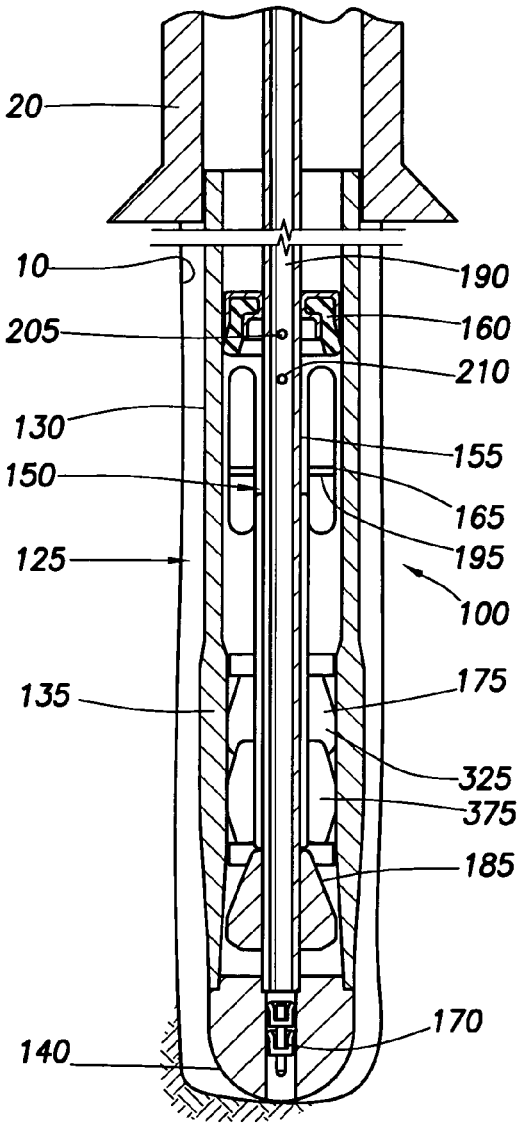
FIG. 2C is a sectional view illustrating a two-position cone positioned in the launcher.
Figure 2D:
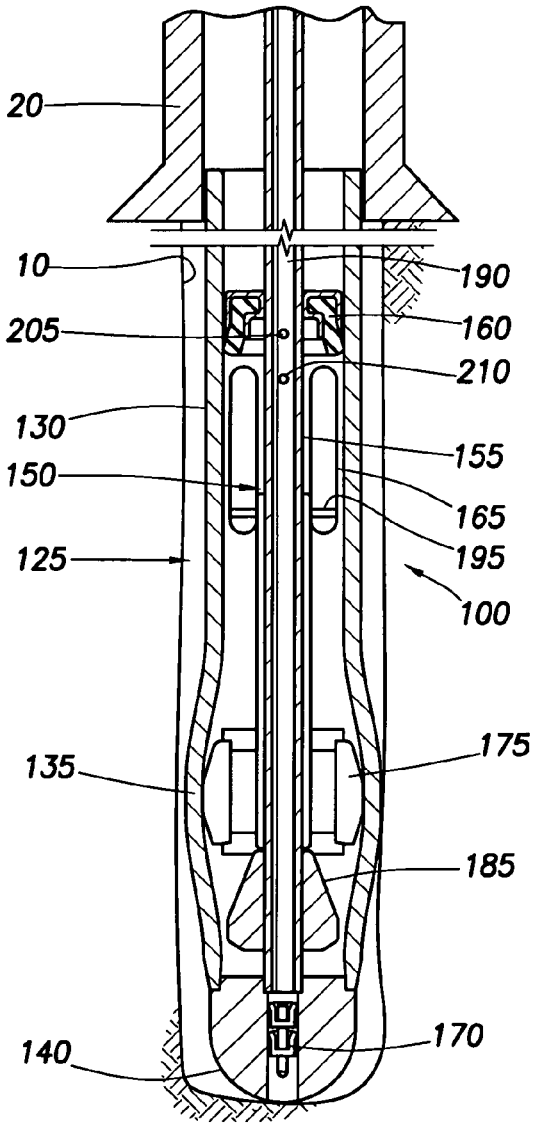
FIG. 2D is a sectional view illustrating the activated two-position cone in the corrugated liner section.

Thereafter, the selectively actuated port 210 is opened and fluid is once again introduced into the bore 190 of the tubular member 155. As fluid enters through the port 210, the piston 195 urges the two-position expander 175 toward the cone 185 as illustrated in FIG. 2C. Upon hitting the cone 185, the two-position expander 175 begins to move from a first position to a second, extended position. As the piston 195 continues to urge the two-position expander 175 against the cone 185, a plurality of first and second cone segments 325, 375 move radially outward. After the two-position expander 175 has been extended to the second position, the port 210 is closed to maintain a fluid pressure against the piston 195 and thereby retain the two-position expander 175 in the second position. For a more detailed discussion of the two-position expander 175, refer to FIGS. 3A and 3B.

FIG. 2D is a sectional view illustrating the activated two-position expander 175 in the corrugated liner section 135. As shown, the two-position expander 175 has expanded a portion of the corrugated liner section 135 from the folded diameter to the unfolded diameter. In other words, during the expansion process, the two-position expander 175 basically "irons out" the crinkles in the corrugated liner section 135 so that the corrugated liner section 135 is substantially reformed into its initial, substantially tubular shape. The liner section 135 is therefore no longer corrugated, but essentially tubular-shaped.

The above description of the process of reformation and subsequent expansion is described in relation to the expandable liner assembly 125. Ordinarily, an expandable tubular such as the liner assembly 125 may only be expanded to an inner diameter which is 22–25% larger than its original inner diameter when an expandable tubular is expanded past its elastic limit. The reforming process allows expansion without using up this limit of expansion of the tubular past its elastic limit, so that the lower portion may be expanded up to 25% larger than the original inner diameter before deformation. Advantageously, reforming the casing string may allow an increase in the inner diameter of the casing string of up to about 50% without tapping the 25% limit on the elastic deformation of the tubular. The subsequent expansion process then allows expansion of the tubular the additional 25%. In this way, the inner diameter of the tubular may be expanded up to about 75–80% of its original inner diameter, rather than the mere 25% expansion which was previously possible.

Figure 2E:
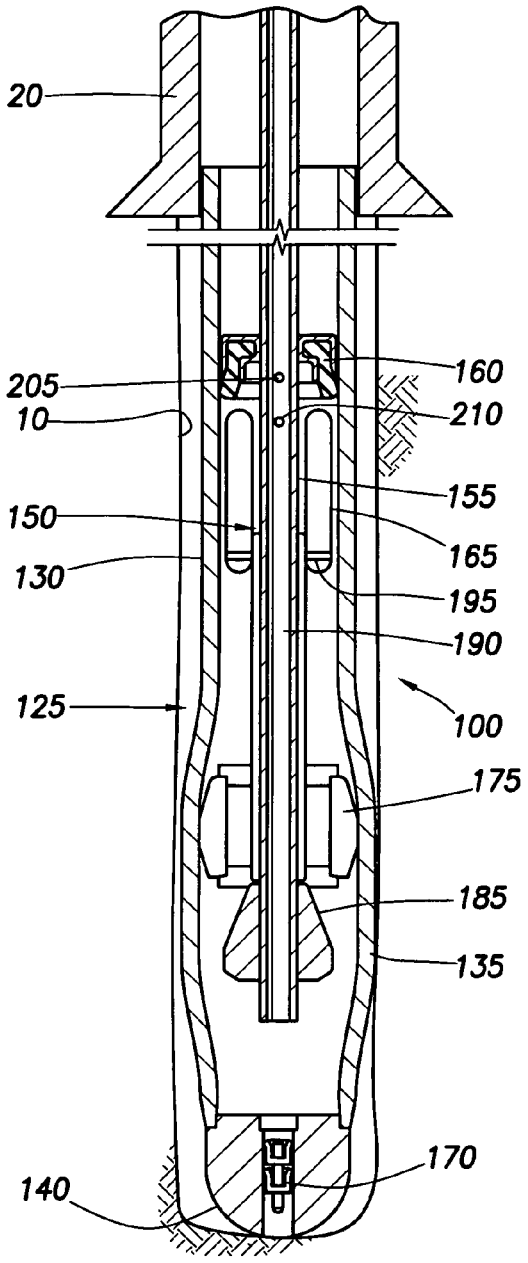
FIG. 2E is a sectional view illustrating a liner assembly being expanded.

After reforming the corrugated liner section 135 to the substantially tubular shape, additional fluid pressure is introduced through the bore 190 into an area below the seal 160 to continue the movement of the expansion assembly 150 relative to the liner assembly 125, as shown in FIG. 2E. In this manner, substantially the entire length of liner sections 130, 135 is expanded into contact with the surrounding wellbore 10 and the casing 20 as illustrated in FIG. 2E. Thereafter, the expansion assembly 150 is removed from the liner assembly 125. In one embodiment, a second seal cup (not shown) may be employed above the seal cup 160 to urge the expansion assembly through the casing 20 after the expansion assembly 150 is removed from the liner assembly 125.

Figure 2F:
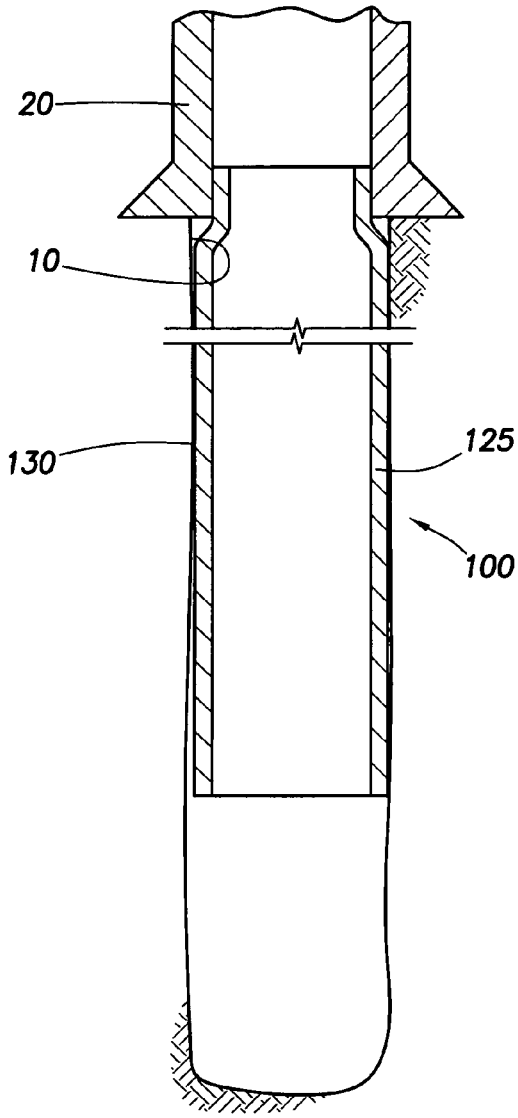
FIG. 2F is a sectional view of a completed wellbore.

FIG. 2F is a sectional view of a completed wellbore. As shown, the expansion assembly has been removed and the liner assembly 125 has been fully expanded into contact with the surrounding wellbore 10 and the casing 20. As further shown, the shoe and a portion of the liner section 135 have been removed from the lower end of the liner assembly 125 by subsequently drilling through them. It should be noted that the liner assembly 125 is expanded in direct contact with the surrounding wellbore 10 without the need for a cementing operation. In this respect, the expansion system 100 of the present embodiment may be used to place a liner in a wellbore without requiring the additional step of under-reaming a newly formed hole as previously discussed or the additional step of cementing the liner in the wellbore after expansion thereof.

Figure 3A:
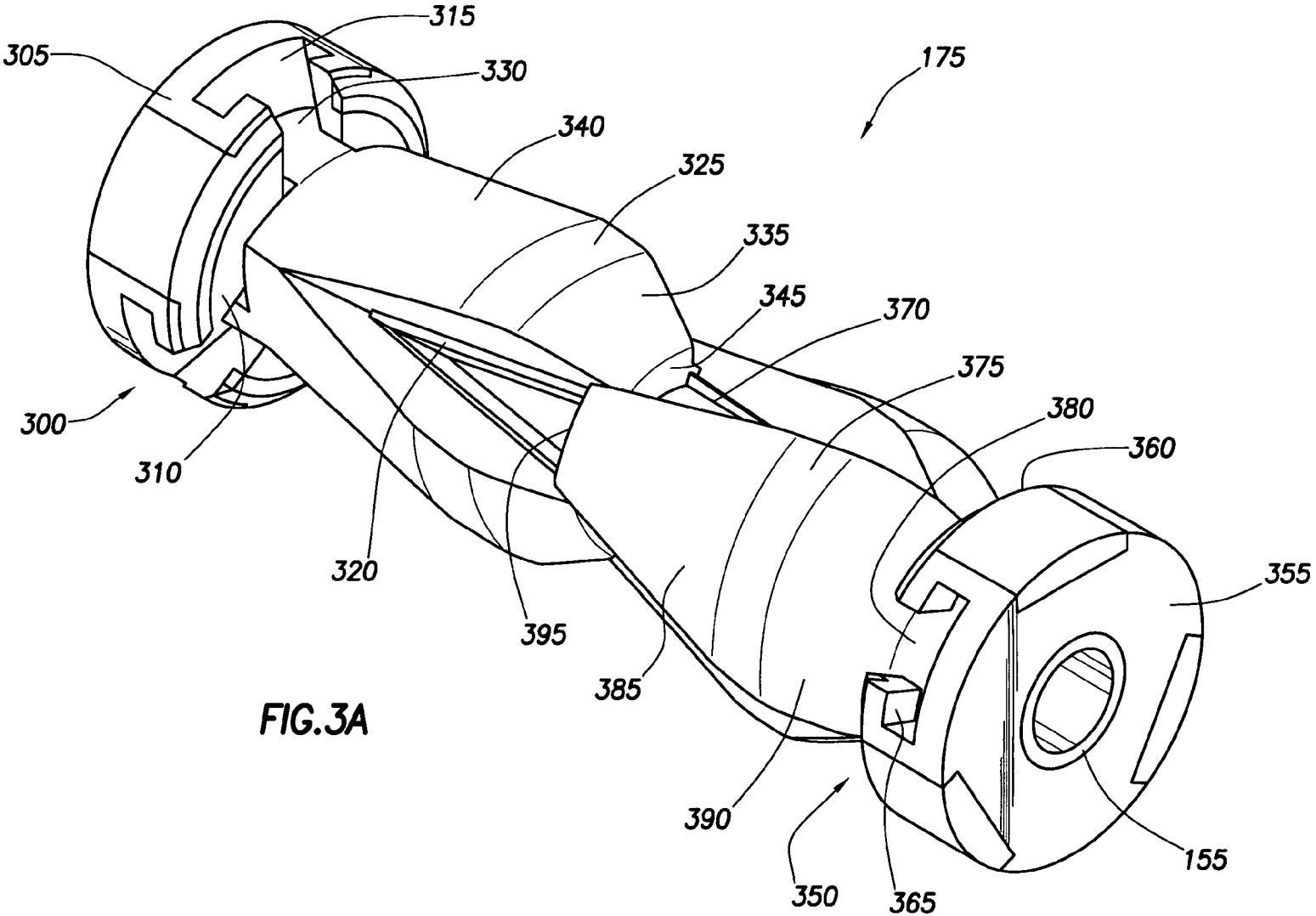
FIG. 3A is an enlarged view of the two-position cone prior to radially extending the cone segments.

FIG. 3A is an enlarged view of the two-position expander 175 prior to radially extending the cone segments 325, 375. Generally, the two-position expander 175 comprises a first assembly 300 and a second assembly 350. The first assembly 300 includes a first end plate 305 and the plurality of cone segments 325. The first end plate 305 is a substantially round member with a plurality of "T"-shaped grooves 315 formed therein. Each groove 315 matches a "T"-shaped profile 330 formed at an end of each cone segment 325. It should be understood, however, that the groove 315 and the profile 330 are not limited to the "T"-shaped arrangement illustrated in FIG. 3A but may be formed in any shape without departing from principles of the present invention.

Each cone segment 325 has an outer surface that includes a first taper 340 adjacent to the shaped profile 330. As shown, the first taper 340 has a gradual slope to form the leading shaped profile of the two-position expander 175. Each cone segment 325 further includes a second taper 335 adjacent to the first taper 340. The second taper 335 has a relatively steep slope to form the trailing profile of the two-position expander 175. The inner surface of each cone segment 325 preferably has a substantially semi-circular shape to allow the cone segment 325 to slide along an outer surface of the tubular member 155. Furthermore, a track portion 320 is formed on each cone segment 325. The track portion 320 is used with a mating track portion 370 formed on each cone segment 375 to align and interconnect the cone segments 325, 375. In this embodiment, the track portion 320 and mating track portion 370 arrangement is similar to a tongue and groove arrangement. However, any track arrangement may be employed without departing from principles of the present invention.

Similar to the first assembly 300, the second assembly 350 of the two-position expander 175 includes a second end plate 355 and the plurality of cone segments 375. The end plate 355 is preferably a substantially round member with a plurality of "T"-shaped grooves 365 formed therein. Each groove 365 matches a "T"-shaped profile 380 formed at an end of each cone segment 375.

Each cone segment 375 has an outer surface that includes a first taper 390 adjacent to the shaped profile 380. As shown, the first taper 390 has a relatively steep slope to form the trailing shaped profile of the two-position expander 175. Each cone segment 375 further includes a second taper 385 adjacent to the first taper 390. The second taper 385 has a relatively gradual slope to form the leading profile of the two-position expander 175. The inner surface of each cone segment 375 preferably has a substantially semi-circular shape to allow the cone segment 375 to slide along an outer surface of the tubular member 155.

Figure 3B:
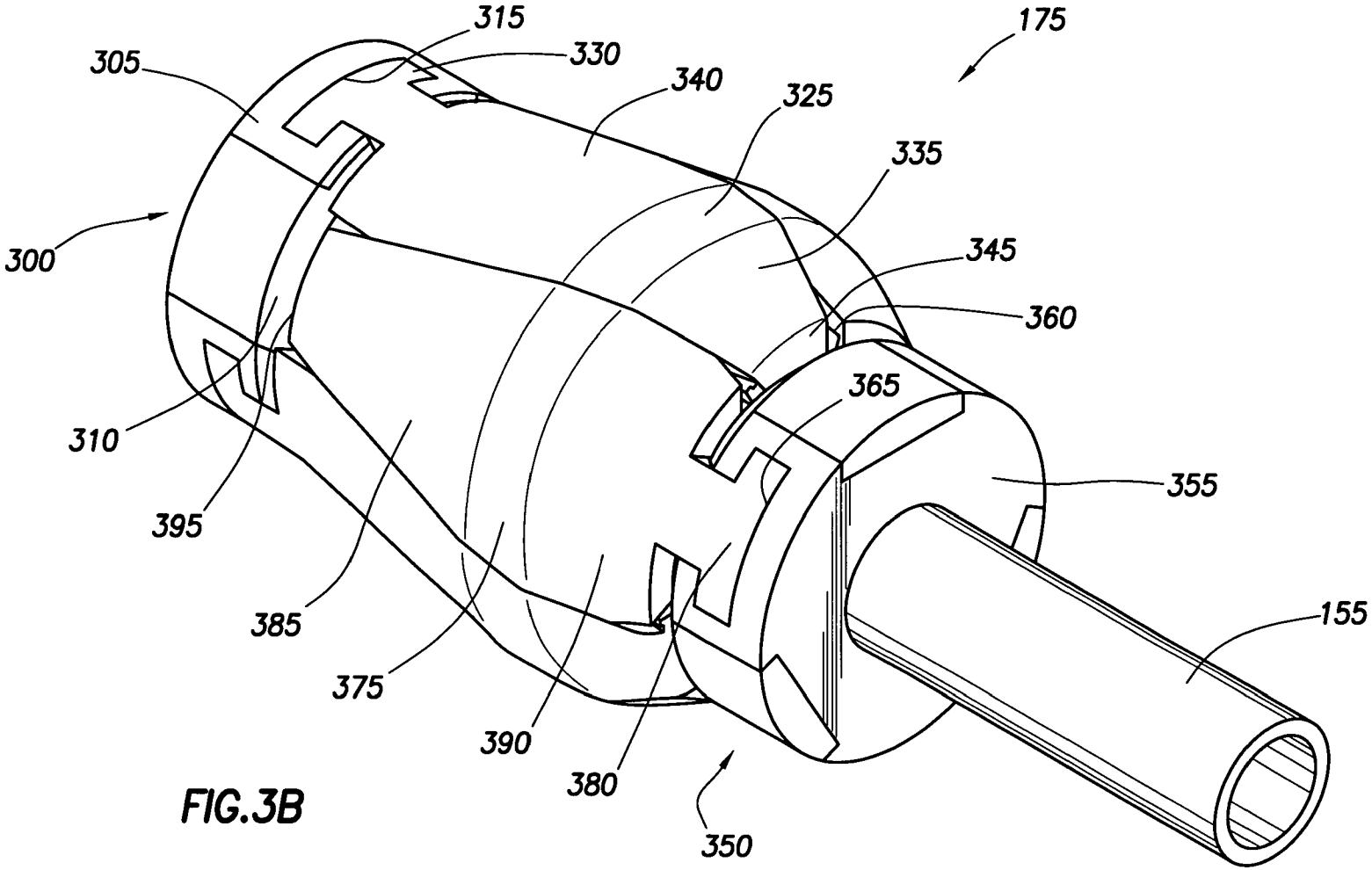
FIG. 3B is an enlarged view of the two-position cone after radially extending the cone segments.

FIG. 3B is an enlarged view of the two-position expander 175 after radially extending the cone segments 325, 375. In a similar manner as discussed in relation to FIGS. 2C and 2D, the first assembly 300 and the second assembly 350 are urged linearly toward each other along the tubular member 155. As the first assembly 300 and the second assembly 350 approach each other, the cone segments 325, 375 are urged radially outward. More specifically, as the cone segments 325, 375 travel linearly along the track portion 320 and mating track portion 370, a front end 395 of each cone segment 375 wedges the cone segments 325 apart, thereby causing the shaped profile 330 to travel radially outward along the shaped groove 315 of the first end plate 305. Simultaneously, a front end 345 of each cone segment 325 wedges the cone segments 375 apart, thereby causing the shaped profile 380 to travel radially outward along the shaped groove 365 of the second end plate 355. The radial and linear movement of the cone segments 325, 375 continue until each front end 345, 395 contacts a stop surface 310, 360 on each end plate 305, 355 respectively. In this manner, the two-position expander 175 is moved from the first position having a first diameter to the second position having a second diameter that is larger than the first diameter.

Although the expander 175 illustrated in FIGS. 3A and 3B is a two-position expander, the expander 175 may be a multi-position expander having any number of positions without departing from principles of the present invention. For instance, the cone segments 325, 375 could move along the track portion 320 and mating track portion 370 from the first position having a first diameter to the second position having a second diameter and subsequently to a third position having a third diameter that is larger than the first and second diameters.

Figures 4A, 4B, 4C, 4D, 4E, 4F:
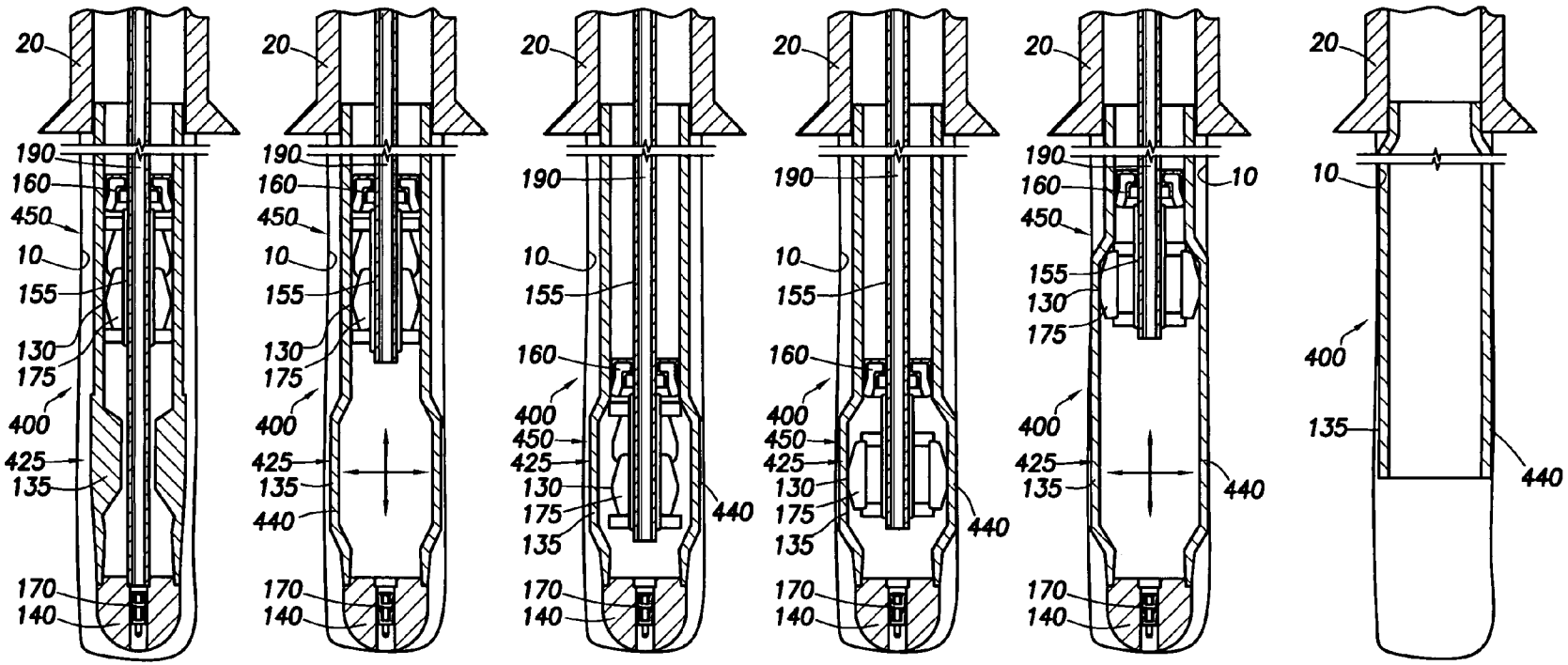
FIG. 4A is a sectional view illustrating a further embodiment of an expansion system for use in a wellbore.
FIG. 4B is a sectional view illustrating a corrugated liner being expanded to form a launcher.
FIG. 4C is a sectional view of the expansion system after positioning the two-position cone in the launcher.
FIG. 4D is a sectional view of the expansion system illustrating the liner section being expanded.
FIG. 4E is a sectional view of the expansion system illustrating the upper liner section being expanded in contact with a surrounding casing.
FIG. 4F is a sectional view of a completed wellbore.

FIG. 4A is a sectional view illustrating a further embodiment of an expansion system 400 for use in a wellbore 10. For convenience, the components in the expansion system 400 that are similar to the components in the expansion system 100 will be labeled with the same number indicator.

The system 400 includes a liner assembly 425 and an expansion assembly 450. The liner assembly 425 is set in the casing 20 by positioning an upper portion of the liner assembly 425 in an overlapping relationship with a lower portion of the casing 20, as illustrated in FIG. 4A. Thereafter, the expansion assembly 450 is employed to expand the liner assembly 425 into engagement with the casing 20 and the surrounding wellbore 10 as will be further described herein.

The liner assembly 425 includes a substantially cylindrical liner section 130 at an upper end thereof and a shaped or a corrugated liner section 135 disposed at the lower end thereof. It should be understood, however, that the corrugated liner section 135 may be located at any position along the liner assembly 425 without departing from principles of the present invention. In a similar manner as previously discussed in FIGS. 2A and 2G, the corrugated liner section 135 has a folded wall describing a folded diameter which can be reformed to define a larger folded diameter and subsequently can be expanded to define a still larger unfolded diameter. Furthermore, the liner assembly 425 further includes a shoe 140 at the lower end thereof.

As shown in FIG. 4A, the expansion assembly 450 is disposed in the liner assembly 425. The expansion assembly 450 includes a tubular member 155 that runs the entire length of the expansion assembly 450. An upper end of the tubular member 155 is attached to a work string (not shown) and a lower end of the tubular member 155 is releaseably connected to the shoe 140 of the liner assembly 425. The tubular member 155 includes a bore 190 in fluid communication with the surface of the wellbore 10. Among other things, the tubular member 155 provides a means for supporting the liner assembly 425.

The expansion assembly 450 further includes a front seal 160 to act as a fluid piston to move the expansion assembly 450 through the liner assembly 425 upon introduction of a fluid pressure below the front seal 160. Additionally, the expansion assembly 450 includes a two-position expander 175 similar to the two-position expander as discussed in FIGS. 3A and 3B.

FIG. 4B is a sectional view illustrating the reforming or unfolding of the corrugated liner 135 to form a launcher 440. The launcher 440 is an area in the liner assembly 425 that is formed to house the unactuated two-position-expander 175 prior to expanding the liner assembly 425 into contact with the wellbore 10.

The expansion system 400 is lowered into the wellbore 10 while simultaneously circulating fluid through the expansion system 400. After the expansion system 400 is positioned within the wellbore 10, the hydraulic isolation device 170 is introduced into the bore 190 of the tubular member 155. Thereafter, the isolation device travels through the bore 190 until it lands in the seat of the shoe 140, thus closing off fluid communication through the shoe 140. As additional fluid is introduced into the bore 190 from the surface of the wellbore 10, the fluid travels through the bore 190 and exits through a selectively actuated port (not shown) at the lower end of the liner assembly 425. As fluid pressure builds in the liner assembly 425, the corrugated liner section 135 starts to reform or unfold from the folded diameter to the larger folded diameter due to the fluid pressure. In this manner, the launcher 440 is formed in the liner assembly 425, as shown in FIG. 4B.

FIG. 4C is a sectional view of the expansion system 400 after positioning the two-position expander 175 in the launcher 440. After the launcher 440 is formed, the fluid pressure below the seal 160 is released by allowing fluid to exit through the tubular member 155 through the selectively actuated port, thereby causing the expansion assembly 450 to move relative to the liner assembly 425 toward the shoe 140.

FIG. 4D is a sectional view of the expansion system 400 illustrating the expansion of the corrugated liner section 135. In a similar manner as previously discussed, the two-position expander 175 is activated. Thereafter, additional fluid pressure is introduced through the bore 190 into an area below the seal 160 to move the expansion assembly 450 relative to the liner assembly 425. At this time, the two-position expander 175 expands the corrugated liner section 135 from the folded diameter to the unfolded diameter. During the expansion procedure, the two-position expander 175 "irons out" the crinkles in the corrugated liner section 135 so that the corrugated liner section 135 is substantially reformed into its initial, substantially tubular shape. Reforming and subsequently expanding allows further expansion of the corrugated liner section 135 than was previously possible because the reformation process does not use up the 25% limit on expansion past the elastic limit, as described above.

FIG. 4E is a sectional view of the expansion system 400 illustrating the expansion of the upper liner section 130. Additional fluid pressure is introduced through the bore 190 into an area below the seal 160 to continue the movement of the expansion assembly 450 relative to the liner assembly 425. FIG. 4E shows a length of the liner assembly 425 being expanded into contact with the surrounding wellbore 10. In this manner, substantially the entire length of liner sections 130, 135 is expanded into contact with the surrounding wellbore 10 and the casing 20 as illustrated in FIG. 4F. In one embodiment, a settable fluid, such as cement, may be employed to seal an annulus formed between the liner sections 130,135 and the surrounding wellbore 10.

Figure 5A:
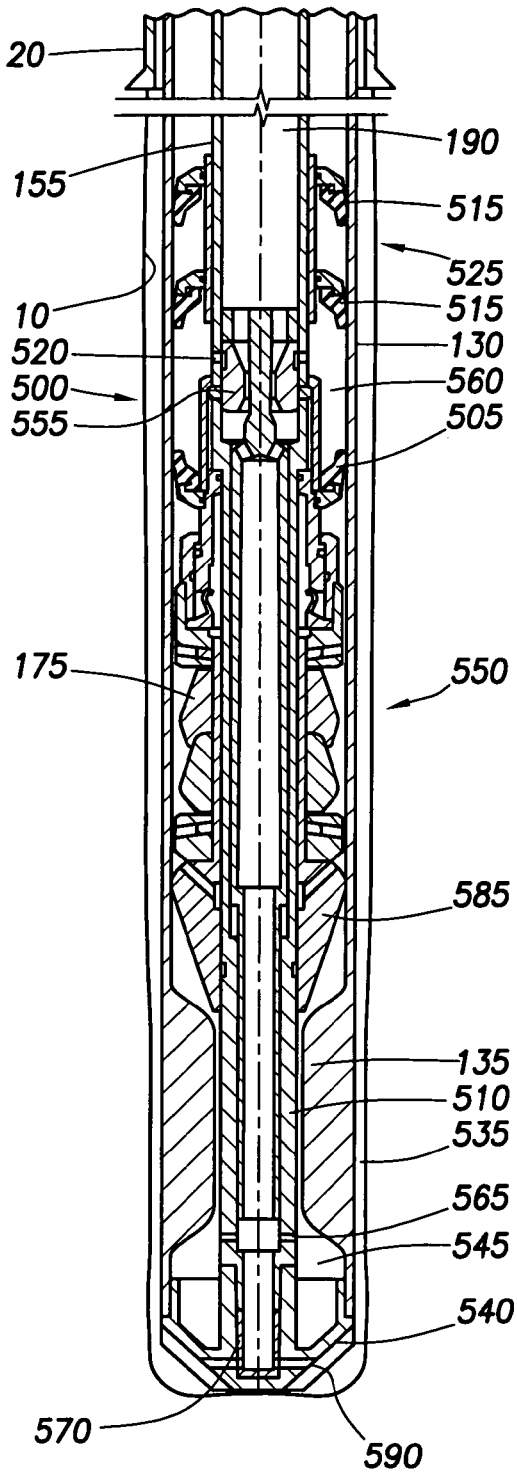
FIG. 5A is a sectional view illustrating a further embodiment of an expansion system for use in a wellbore.

FIG. 5A is a sectional view illustrating a further embodiment of an expansion system 500 for use in a wellbore 10. For convenience, the components in the expansion system 500 that are similar to the components in the expansion system 100 will be labeled with the same number indicator.

Similar to the previously discussed embodiments, the expansion system 500 includes a liner assembly 525 and an expansion assembly 550. Generally, the liner assembly 525 is set in the casing 20 by positioning an upper portion of the liner assembly 525 in an overlapping relationship with the lower portion of the casing 20, as illustrated in FIG. 5A. Thereafter, the expansion assembly 550 is employed to expand the liner assembly 525 into engagement with the casing 20 and the surrounding wellbore 10, as will be further described herein.

The liner assembly 525 includes a substantially cylindrical liner section 130 at an upper end thereof and a shaped or a corrugated liner section 135 disposed at the lower end thereof. It should be understood, however, that the corrugated liner section 135 may be located at any position along the liner assembly 525 without departing from principles of the present invention. In a similar manner as previously discussed in FIG. 2 and 2A, the corrugated liner section 135 has a folded wall describing a folded diameter which can be substantially reformed or unfolded to define a larger folded diameter and subsequently can be expanded to define a still larger unfolded diameter.

Furthermore, the liner assembly 525 further includes a shoe 540 at the lower end thereof. The shoe 540 includes a valve member 570 at the lower end thereof to selectively allow fluid communication between the bore 190 and an annulus 535 formed between the expansion system 500 and the surrounding wellbore 10. During the run-in procedure, fluid circulates through the bore 190 and through a plurality of ports 590 into the annulus 535 to remove any extraneous debris in the wellbore 10.

As shown in FIG. 5A, the expansion assembly 550 is disposed in the liner assembly 525. The expansion assembly 550 includes a tubular member 155 that runs substantially the entire length of the expansion assembly 550. An upper end of the tubular member 155 is attached to a work string (not shown) and a lower end of the tubular member 155 is operatively attached to the shoe 540 of the liner assembly 425 through a mandrel 510. The tubular member 155 includes a bore 190 in fluid communication with the surface of the wellbore 10. Among other things, the tubular member 155 provides a means for supporting the liner assembly 525.

The mandrel 510 is a generally tubular member that is attached between the tubular member 155 and the shoe 540. In the embodiment illustrated in FIG. 5A, the mandrel 510 is attached to the shoe 540 by a threaded connection therebetween. It should be understood, however, that any connection means may employed to connect the mandrel 510 to the shoe 540 without departing from principles of the present invention. To equalize the pressure between the expansion system 500 and the surrounding wellbore 10, the mandrel 510 includes a one or more ports 565 to allow fluid communication between the bore 190 and an annulus 545 formed between the expansion assembly 550 and the liner assembly 525.

The expansion assembly 550 includes a cone 585. The cone 585 is a tapered member that is operatively attached to the tubular member 155, whereby movement of the tubular member 155 in relation to the liner assembly 525 will also move the cone 585. Adjacent to the cone 585 is a two-position expander 175, which was discussed in greater detail in a subsequent paragraph. As shown, during the run-in procedure, both the two-position expander 175 and the cone 585 are disposed adjacent an end of the corrugated liner section 135.

As shown, a lower seal 505 and one or more upper seals 515 are disposed around the tubular member 155. The seals 505, 515 are preferably fabricated from a pliable material, such as an elastomer, to provide a fluid-tight seal between the expansion assembly 550 and the liner assembly 525. The primary function of the seals 505, 515 is to act as a fluid piston to move the expansion assembly 550 relative to the liner assembly 525 upon introduction of a fluid pressure below the seals 505, 515. Initially, the seals 505, 515 are locked or restrained from movement during the run-in procedure.

Figure 5B:
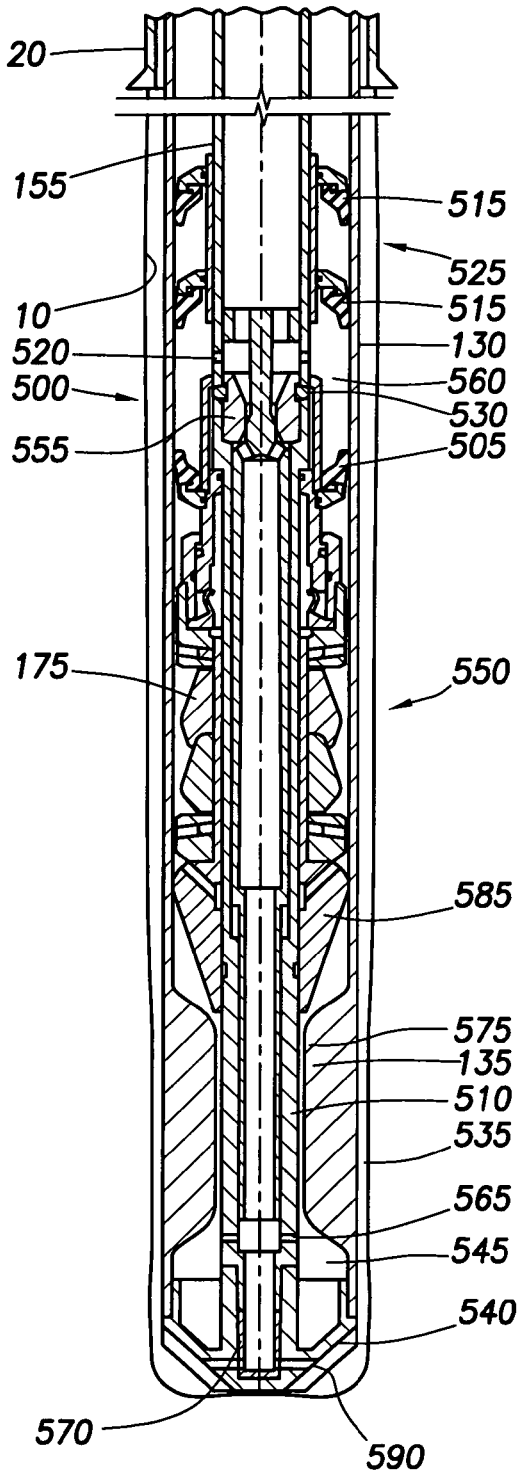
FIG. 5B is a sectional view illustrating a corrugated liner being unfolded to form a launcher.

Disposed between the lower seal 505 and the plurality of upper seals 515 is a port 520 that is selectively opened by a valve 555. The port 520 allows fluid communication between the bore 190 and an annulus 560. The valve 555 is actuated by fluid pressure, whereby at a predetermined pressure flowing through the bore 190, the valve 555 shifts downward, exposing the port 520 and allowing fluid communication between the bore 190 and the annulus 560, as shown in FIG. 5B. Alternatively, a hydraulic isolation device (not shown) may be employed to actuate the valve 555, whereby the hydraulic isolation device blocks the flow of fluid through the bore 190 and shifts the valve 555 downward to expose the port 520 to fluid communication.

FIG. 5B is a sectional view illustrating the lower cone 585 partially reforming the corrugated liner 135 to form a launcher 575. Fluid is pumped from the surface of the well through the bore 190 to act upon the valve 555, whereby at a predetermined fluid pressure the valve 555 moves downward to open the port 520. As the valve 555 moves downward, an outwardly-biased member 530 expands into grooves formed in the valve member 555, thereby unlocking the movement restraint on the lower seals 505. As fluid flows from the bore 190 into the annulus 560, a fluid pressure is created on the seals 515, 505. However, since the seals 515 remain locked or restrained in the position illustrated, the fluid pressure causes the lower seal 505 to move downward relative to seals 515. The movement of the lower seal 505 causes the two-position expander 175 and cone 585 to move downward relative to the liner assembly 525. As the cone 585 moves downward, fluid in the annulus 545 causes the corrugated liner section 135 to partially reform or unfold from the folded diameter to the larger folded diameter to form the launcher 575. Thereafter, the cone 585 may be employed to ensure that the launcher 575 is properly formed.

Figure 5C:
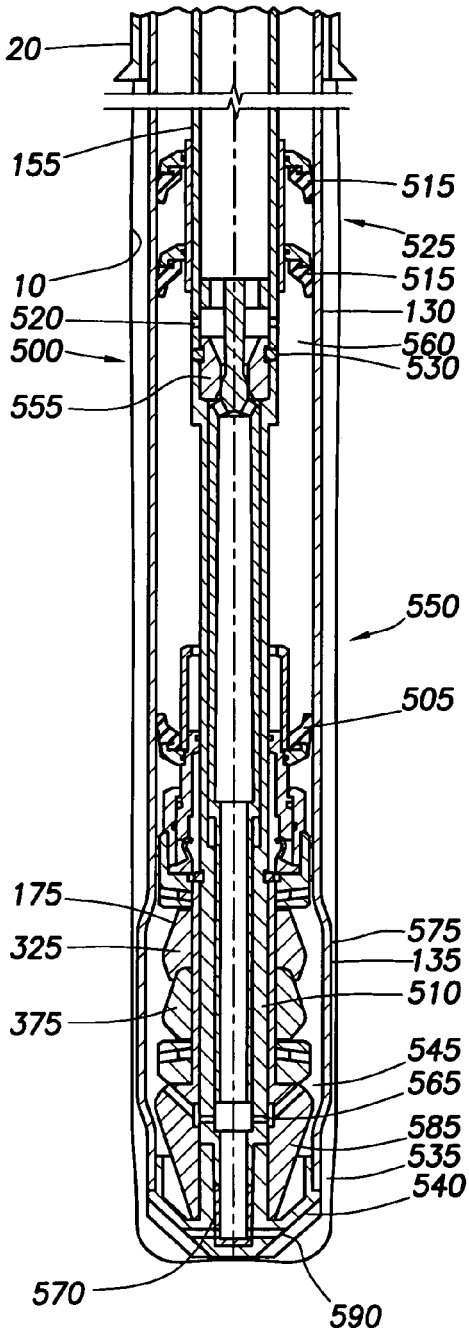
FIG. 5C is a sectional view illustrating the two-position cone in the launcher.

FIG. 5C is a sectional view illustrating the two-position expander 175 in the launcher 575. After the launcher 575 is formed, the cone 585 contacts the shoe 540 as illustrated. At the same time, fluid continues to be introduced into the annulus 560, thereby causing the two-position expander 175 to move closer to the cone 585 to begin the activating process. As the fluid pressure continues to urge the two-position expander 175 against the cone 585, a plurality of first and second cone segments 325, 375 move radially outward into contact with the surrounding liner 135. For a more detailed discussion of the two-position expander 175, please refer to the discussion above in relation to FIGS. 3A and 3B.

Figure 5D:
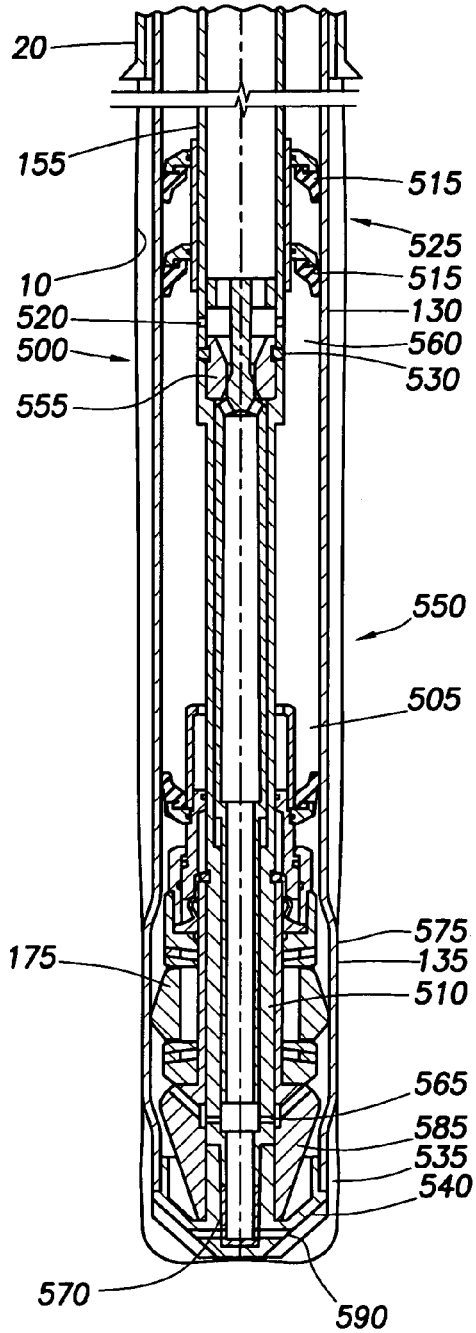
FIG. 5D is a sectional view illustrating the corrugated liner section being expanded by the two-position cone.
Figure 5E:
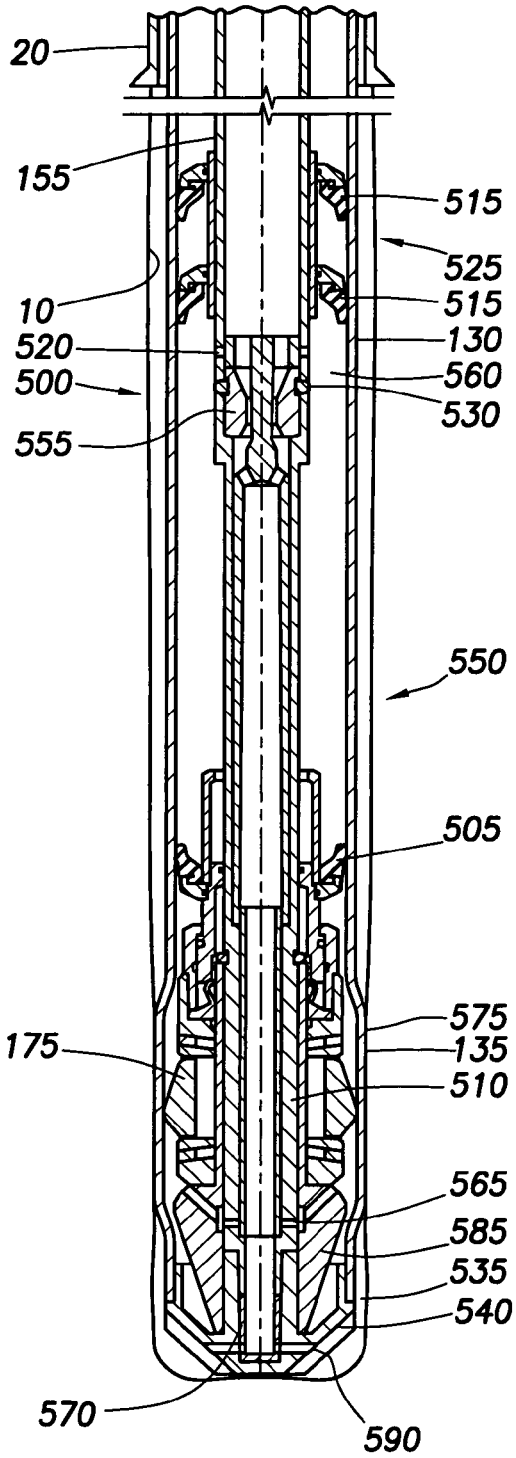
FIG. 5E is a sectional view illustrating the expansion system after a selectively actuated port has been closed.

FIG. 5D is a sectional view illustrating the two-position expander 175 expanding the corrugated liner section 135. As shown, the two-position expander 175 has expanded a portion of the liner section 135 from the folded diameter to the unfolded diameter. In other words, during expansion process, the two-position-expander 175 basically "irons out" the crinkles in the corrugated liner section 135 so that the liner section 135 is substantially reformed into its initial tubular shape. Reforming and subsequently expanding allows further expansion of the liner section 135 than was previously possible because the reformation process does not use up the 25% limit on expansion past the elastic limit, as described above. Thereafter, the ports 520 are closed as illustrated in FIG. 5E.

Subsequently, the expansion assembly 550 is rotated in one direction to release the threaded connection between the mandrel 510 and the shoe 540 and the threaded connection between the valve member 570 and the shoe 540. At this point, the expansion assembly 550 and the liner assembly 525 are disconnected, thereby unlocking the upper seals 515.

Figure 5F:
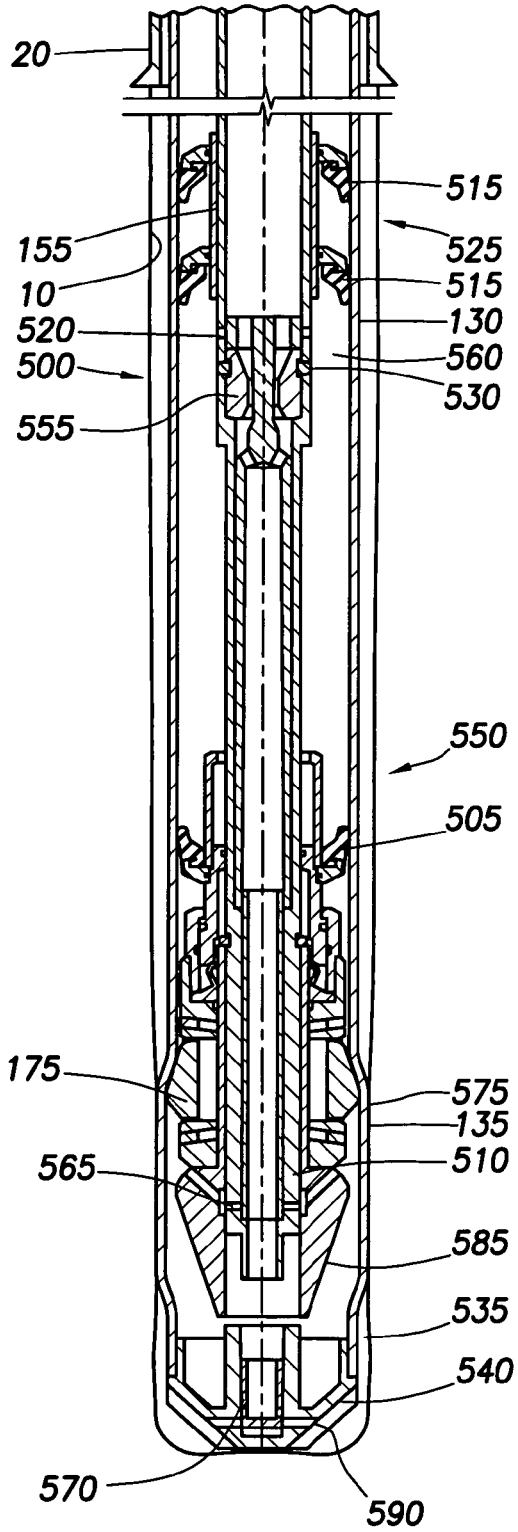
FIG. 5F is a sectional view illustrating a length of the liner assembly being expanded by the two-position cone.

As additional fluid pressure is introduced through the bore 190, the entire expansion assembly 550 is moved relative to the liner assembly 525 as fluid pressure acts upon seals 515, as illustrated in FIG. 5F. In this manner, substantially the entire length of liner sections 130, 135 are expanded into contact with the surrounding wellbore 10 and the casing 20.

As will be discussed in FIGS. 6–9, embodiments of the present invention may be employed in various wellbore completion operations, such as forming a reverse telescopic wellbore, forming a substantially monobore wellbore, or adding a cladding to an existing wellbore. It should be understood, however, that the present invention may be employed in any number of completion operations without departing from principles of the present invention.

Figure 6:
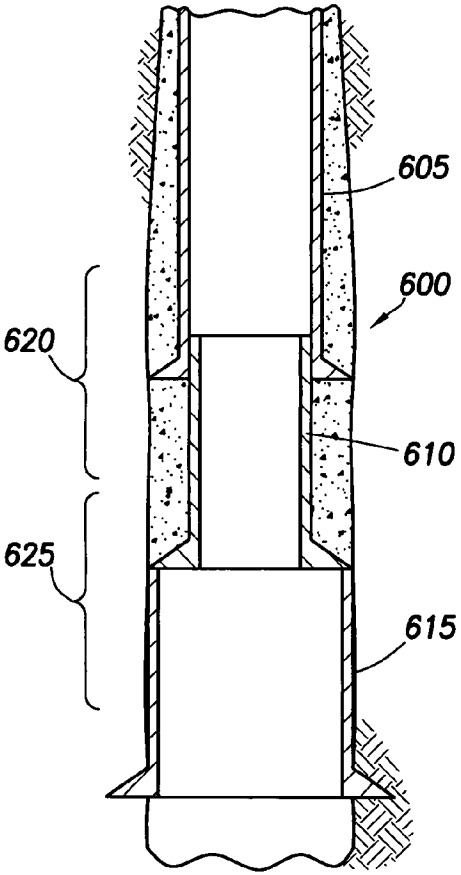
FIG. 6 is a sectional view illustrating a reverse telescopic wellbore.

FIG. 6 is a sectional view illustrating a reverse telescopic wellbore 600. As shown, the wellbore 600 includes an upper string of casing 605, a middle string of casing 610 and a lower string of casing 615. Embodiments of the present invention may be employed to form the reverse telescopic wellbore 600 in a similar manner as described in FIGS. 2–5. For instance, embodiments of the present invention may be used to attach the middle string of casing 610 to the upper string of casing 605 to form a telescopic portion 620. Furthermore, embodiments of the present invention may be used to attach the lower string of casing 615 to the middle string of casing 610 to form a reverse telescopic portion 625. Reforming and subsequently expanding allows further expansion of the casing 615 than was previously possible because the reformation process does not use up the 25% limit on expansion past the elastic limit, as described above. In this way, the reformation and expansion process reduces the annulus between the wellbore 600 and the casing 615 so that a reverse telescopic portion 625 may be formed despite the restriction in wellbore inner diameter.

Embodiments of the present invention may be employed to place an expandable sand screen (not shown) in a wellbore in a similar manner as described in FIGS. 2–5. Sand screens are designed to permit the passage of production fluid therethrough but to inhibit the passage of particulate matter, such as sand. An expandable slotted tubular usable as a sand screen and a method for its use is described in U.S.

Pat. No. 6,454,013 assigned to the same entity as the present application, and that publication is incorporated herein by reference in its entirety.

Furthermore, the sand screen may be employed with a solid tubular, such as the corrugated liner, to allow selective production from a predetermined location in the wellbore. For instance, embodiments of the present invention may be used to place the sand screen and the tubular adjacent the predetermined location and subsequently expand the sand screen and the tubular into contact with the surrounding wellbore. Thus, the expanded sand screen permits the passage of production fluid therethrough and the expanded tubular isolates a portion of the wellbore, thereby allowing selective production from the wellbore.

Figure 7:
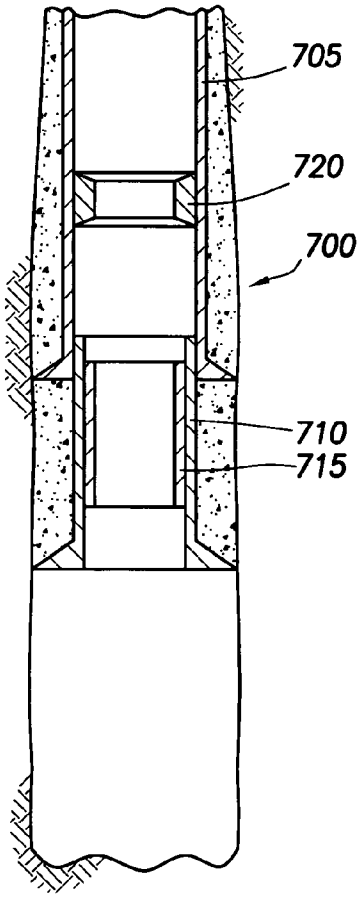
FIG. 7 is a sectional view illustrating a wellbore having a cladding section disposed therein.

FIG. 7 is a sectional view illustrating a wellbore 700 having a cladding section 715 disposed therein. As shown, the wellbore 700 includes an upper string of casing 705 and a lower string of casing 710. Generally, a cladding section 715 or a patch is used to patch leaking paths existing in the wellbore or cased wellbore. Embodiments of the present invention may be employed to place the cladding section 715 or patch in the wellbore 700 in a similar manner as described in FIGS. 2–5. For instance, embodiments of the present invention may be used to position the cladding section 715 adjacent the lower string of casing 710 and subsequently expand the cladding section 715 into contact with the lower string of casing 710.

The cladding section 715 or the patch may also be employed in an open-hole zonal isolation operation. For instance, embodiments of the present invention may be used to position the patch in an open-hole wellbore and subsequently expand the patch into contact with the open-hole wellbore to isolate a predetermined length of the wellbore. Additionally, cement, elastomers or swelling elastomers may be employed in addition to the patch to further ensure isolation of the predetermined length of the open-hole wellbore.

Additionally, embodiments of the present invention may pass through a restriction 720 in the inner diameter of the casing string 705, such as a restriction formed by a packer, a deployment valve, or a previously installed casing patch, and then expand the cladding section 715 to an inner diameter at least as large as the restriction once the cladding section 715 or casing patch is lowered below the restriction 720. The reformation and expansion process as described above is advantageous because it allows expansion of the cladding section 715 through the restriction 720 in wellbore inner diameter to over 22–25% of its original inner diameter while still maintaining the structural integrity of the cladding section 715.

Figure 8:
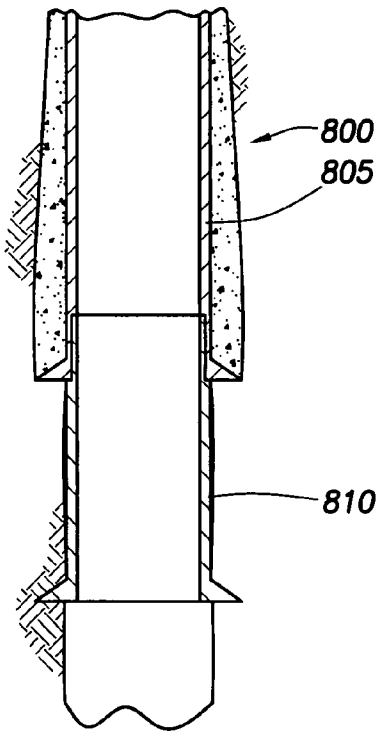
FIG. 8 is a sectional view illustrating a substantially monobore wellbore.

FIG. 8 is a sectional view illustrating a substantially monobore wellbore 800. A monobore wellbore 800 is a wellbore that has approximately the same diameter along its length, causing the path for fluid flow between the surface and the wellbore to remain substantially consistent along the length of the wellbore and regardless of the depth of the well. Embodiments of the present invention may be employed to form the monobore wellbore 800 in a similar manner as described in FIGS. 2–5. For instance, in the formation of the monobore wellbore 800, a first casing string 805 could be inserted into the wellbore in a manner well known in the art. Thereafter, a second casing string 810 of a smaller diameter than the first casing string 805 could be inserted into the wellbore and expanded to approximately the same inner diameter as the first casing string 805. The expansion of the overlapping sections of casing or liner may be such that the lower end of the first casing string 805 has a cut-out portion or is further expanded by the expansion of the upper end of the second casing string 810.

The above process allows the additional expansion of the lower portion of each casing string to form the monobore well 800. Ordinarily, an expandable tubular may only be expanded plastically to an inner diameter 22–25% larger than its original inner diameter. The reforming process described herein allows expansion of a tubular to a diameter over 25% of the original inner diameter.

Figure 9:
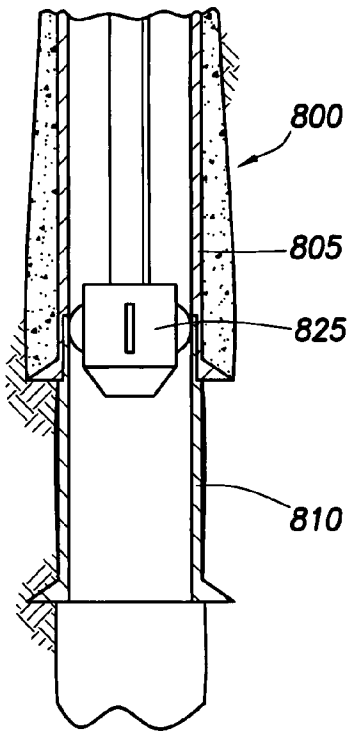
FIG. 9 is a sectional view illustrating a rotary expansion tool further expanding the overlapping sealing portion between the first casing string and the second casing string.

FIG. 9 is a sectional view illustrating a rotary expansion tool 825 further expanding the overlapping sealing portion between the first casing string 805 and the second casing string 810. The expander tool 825 is described in U.S. patent application Ser. No. 10/680,724, filed on Oct. 7, 2003, which application is herein incorporated by reference in its entirety. The expander tool 825 is used to expand the overlapping portion past its elastic limit to regain collapse strength. In other words, the overlapping portion is deformed and then reformed through the use of the expander tool 825 to effectively create a monobore overlap between the first casing string 805 and the second casing string 810.

It will be apparent to those of skill in the art that the above-described embodiments are merely exemplary of the present invention, and that various modifications and improvements may be made thereto without departing from the scope of the invention. For example, the tubing described in the above embodiment is formed of solid-walled tube. In other embodiments the tube could be slotted or otherwise apertured, or could form part of a sandscreen. Alternatively, only a relatively short length of tubing could be provided, for use as a straddle or the like. Also, the above described embodiment is a "star-shaped" folded form, and those of skill in the art will recognize that the present application has application in a range of other configurations of folded or otherwise deformed or deformable tubing. In another example, the expansion assembly moves up relative to the liner assembly, thereby expanding the liner assembly upward toward the surface of the wellbore. In another embodiment, the expansion assembly may be arranged such that the expansion assembly moves down relative to the liner assembly, thus expanding the liner assembly downward away from the surface the wellbore.

While the foregoing is directed to embodiments of the present invention, other and further embodiments of the invention may be devised without departing from the basic scope thereof, and the scope thereof is determined by the claims that follow.

The invention claimed is:

1. A method of expanding a portion of a tubular body in a pre-existing structure, comprising:

positioning the tubular body in the pre-existing structure, the tubular body including a deformed portion;

at least partially reforming the deformed portion;

positioning an expander in the reformed portion, the expander in a first position;

shifting the expander to a second, larger diameter position; and expanding the reformed portion by urging the expander therethrough.

2. The method of claim 1, wherein a cone member is used for reforming the tubular body.

3. The method of claim 1, wherein fluid pressure is used for reforming the tubular body.

4. The method of claim 1, wherein the deformed tubular body comprises a tubular body having a corrugated cross-section.

5. The method of claim 1, wherein at least partially reforming the tubular body comprises expanding the deformed tubular body into a substantially tubular shape.

6. The method of claim 1, wherein at least partially reforming the tubular body comprises enlarging a smallest inner diameter of the deformed tubular body to an inner diameter at least as large as the original tubular body.

7. The method of claim 1, wherein expanding at least the portion of the reformed tubular body comprises enlarging the inner diameter of the reformed tubular body.

8. The method of claim 1, wherein expanding the at least the portion of the reformed tubular body comprises expanding at least the portion of the tubular body past its elastic limit.

9. The method of claim 1, wherein the expander is movable from a first position having an outer diameter to a second position having a larger outer diameter.

10. The method of claim 9, wherein the expander is mechanically actuated.

11. The method of claim 1, wherein the pre-existing structure is a wellbore.

12. A method for completing a wellbore, comprising:

forming a borehole below an existing string of casing;

running a tubular body having a deformed portion into the borehole;

reforming the deformed portion;

positioning a two-position expander in the reformed portion;

shifting the expander to a second, larger diameter position; and expanding at least the portion of the tubular body into contact with the borehole.

13. The method of claim 12, further including shifting the two-position expander from a first position having a diameter to a second position having a larger diameter.

14. The method of claim 12, wherein the tubular body is in a sealing relationship with the borehole.

15. The method of claim 12, further including pumping a settable fluid into an annulus formed between the tubular body and the borehole to form a seal therebetween.

16. A method of forming a substantially reverse telescopic well, comprising:

positioning a deformed tubular body below an existing casing string;

reforming the tubular body; and expanding at least a portion of the reformed tubular body until the expanded tubular body has a larger inner diameter than an inner diameter of the existing casing string.

17. The method of claim 16, further including placing a two-position expander in the reformed tubular body.

18. A formable launcher section, comprising:

a deformed tubular defining a first largest folded diameter, wherein the deformed tubular may be reformed to define a second largest folded diameter and subsequently expanded to define a third largest unfolded diameter which is substantially tubular shaped; and a shoe operatively attached to a lower end of the deformed tubular.

19. The formable section of tubing of claim 18, wherein a cone reforms the deformed tubular.

20. The formable section of tubing of claim 18, wherein pressure reforms the deformed tubular.

21. A method of forming a launcher section, comprising:

providing a tubing section with a shoe disposed at a lower end thereof, the tubing section having a folded wall and describing a folded diameter;

unfolding the wall of the tubing section to define a larger unfolded diameter; and expanding the unfolded wall of the tubing section to a still larger diameter.

22. An expansion system for use in completing a wellbore, comprising:

a deformed liner portion; and a two-position expander, wherein the two-position expander is disposable in the deformed liner portion upon reforming thereof.

23. The expansion system of claim 22, further including at least one seal member, wherein fluid pressure against the seal member urges the two-position expander through the liner portion.

24. The expansion system of claim 23, further including a second seal member disposed adjacent the at least one seal member to urge the two-position expander through the wellbore after the deformed liner portion has been expanded.

25. A method for completing a wellbore, comprising:

positioning an expansion system proximate a lower end of an existing string of casing, the expansion system having a deformed liner portion and a two-position expander;

reforming the liner portion;

positioning the two-position expander in the reformed liner portion;

shifting the expander to a second, larger diameter position; and expanding the reformed liner portion in contact with the wellbore.

26. The method of claim 25, wherein the expansion system further includes a seal member.

27. The method of claim 26, further including creating a fluid pressure below the seal member, thereby urging the two-position expander through the liner portion.

28. A method of forming a substantially monobore well, comprising:

positioning a tubular body below an existing casing string, wherein a portion of the tubular body is in an overlapping relationship with the casing string and the tubular body includes a deformed portion;

reforming the deformed portion; and expanding at least a portion of the reformed tubular body until the expanded tubular body is at least as large as an inner diameter of the existing casing string.

29. The method of claim 28, further including placing a two-position expander in the reformed tubular body.

30. The method of claim 28, further including employing a rotary expander tool in the overlapping portion to expand the overlapping portion past its elastic limit and regain collapse strength.

31. A method of completing a wellbore, comprising:

positioning the tubular body in the wellbore, the tubular body including a deformed portion and a screen portion;

at least partially reforming the deformed portion;

positioning an expander in the reformed portion, the expander in a first position;

shifting the expander to a second, larger diameter position;

expanding the reformed portion by urging the expander therethrough; and expanding at least a part of the screen portion.

* * * * *